US005513709A

United States Patent [19]

Fisher

[11] Patent Number: 5,513,709

[45] Date of Patent: May 7, 1996

[54] POWER TOOL

[76] Inventor: Hugh E. Fisher, Dunree Farm, Dalrymple, Ayrshire KA6 6BA, Scotland

[21] Appl. No.: 704,415

[22] Filed: May 21, 1991

Related U.S. Application Data

[63] Continuation-in-part of Ser. No. 507,609, Apr. 10, 1990, Pat. No. 5,042,592.

[51] Int. Cl.[6] ..... B25D 15/02

[52] U.S. Cl. ..... 173/205; 173/216; 173/217; 173/170; 30/272.1

[58] Field of Search ..... 173/109, 205, 173/122, 124, 216, 217, 170; 30/272.1

[56] References Cited

U.S. PATENT DOCUMENTS

| | | | |
|---|---|---|---|
| 1,505,493 | 8/1924 | Roberts | 173/123 |
| 2,051,053 | 8/1936 | Morris | 173/123 |
| 3,449,967 | 6/1969 | Dancsik | 173/123 |
| 3,789,933 | 2/1974 | Iarecki | 173/123 |
| 3,832,776 | 9/1974 | Sawyer | 30/272.1 |
| 4,073,348 | 2/1978 | Schramm et al. | 173/109 |
| 4,289,210 | 9/1981 | Schoeffler | 173/123 |
| 4,601,351 | 7/1986 | Hartyuig et al. | 173/123 |
| 4,930,583 | 6/1990 | Fushiya et al. | 173/123 |

*Primary Examiner*—Scott A. Smith
*Attorney, Agent, or Firm*—Arnold, White & Durkee

[57] ABSTRACT

The invention provides a portable power tool which is lightweight and convenient to use by the general public in any of its various forms, as a wallpaper stripper, a paint scraper or a cold chisel up to a power spade. The tool comprises a housing (12), a drive, an electric motor (14,160) adapted to drive at least one selected tool bit (4,56,62,64, 66,68) mounted on an output shaft (44) moving in a reciprocating axial manner. Conveniently the drive may be a linear motor (160) or if used with a cam device, a rotary motor (14). The cam device may be a cylinder cam (32) provided with a sinusoidal cam track (34).

10 Claims, 10 Drawing Sheets

POWER TOOL

RELATED APPLICATION DATA

This is a continuation-in-part of application Ser. No. 07/507,609, filed on Apr. 10, 1990, now U.S. Pat. No. 5,042,592.

BACKGROUND OF INVENTION

The invention is concerned with power tools, particularly, but not exclusively relatively lightweight power tools suitable for use by the general public.

A number of power tools are in general use in the handyman's do-it-yourself market, for example, power drills, saws and the like. However, those jobs involving breaking up hard materials such as concrete, slabs, stone or even heavy earth have not readily been tackled by anything less than a heavy duty or industrial tool as for example, a pneumatic drill.

The present invention further provides a portable power tool comprising a housing, a drive means and a mounting arrangement for a selected one of a plurality of interchangeable tool bits, wherein there is provided within the housing an output arrangement adapted to drive an output shaft in a reciprocal axial movement to drive a selected tool bit.

Advantageously the drive means may be a linear output motor. Alternatively, the drive means may be a rotary motor requiring the intermediary of a device, which may be a cam device, to convert rotary motion into axially reciprocating motion.

Conveniently, therefore, there may be provided a cylinder cam mounted for rotation with the output shaft from the motor, said cam being provided with a sinusoidal cam track extending around its circumferential surface, an output shaft adapted to partake of reciprocal axial movement to drive a selected tool bit, and cam follower means adapted to run in said cam track to impart said reciprocal axial motion to said output shaft.

Conveniently, the cylinder cam may be selected from a plurality of cam members having a range of cam throw distances.

Where necessary, intermediate gearing may be interposed between the motor and the output shaft. Conveniently, the motor may be powered by mains electricity using a transformer, or by batteries. If desired, the batteries may be of the rechargeable type or may be replaceable. In an example of the invention, the batteries may be incorporated into a detachable battery/handle module for rapid replacement. In another example mains power is provided by a detachable cable and a battery pack is provided for use in place of mains power when the cable is detached. Conveniently the batteries may be of the rechargeable type.

There will now be described several examples of devices according to the invention. It will be understood that the descriptions are given by way of example only and not by way of limitation.

DESCRIPTION OF THE PREFERRED EMBODIMENTS

Figure 1:
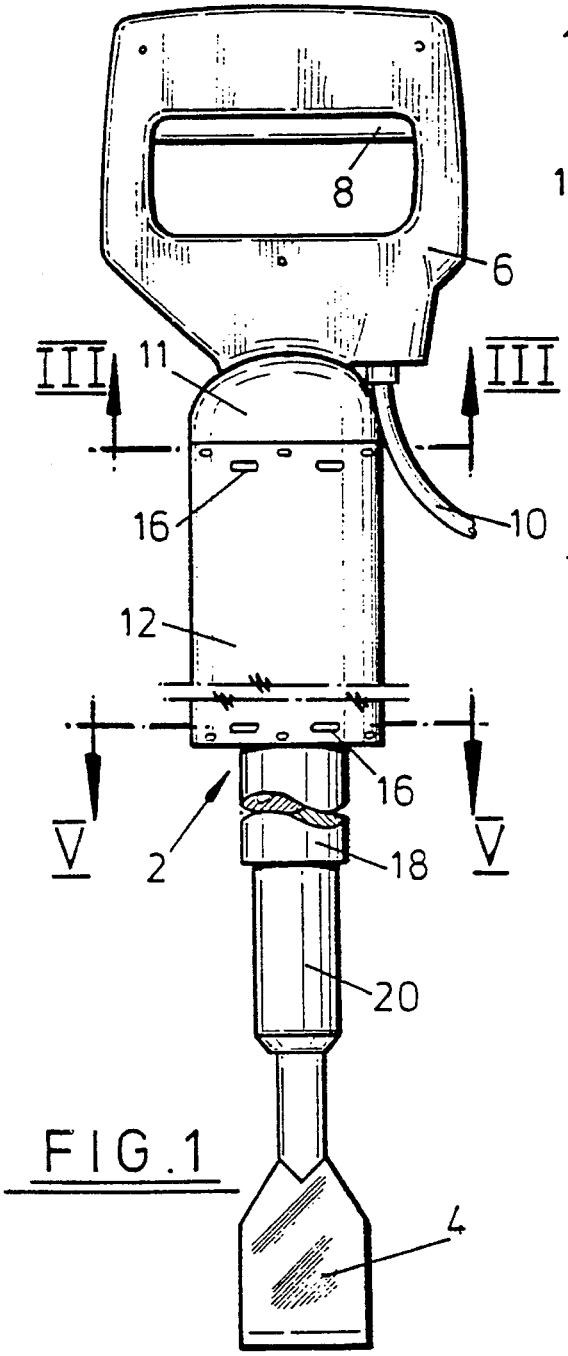
FIG. 1 is an external view of a tool according to the invention.

FIG. 1 shows a tool 2 according to the invention suitable for use with a variety of tool bits, but illustrated in the present example in use with a chisel bit 4.

Figure 2:
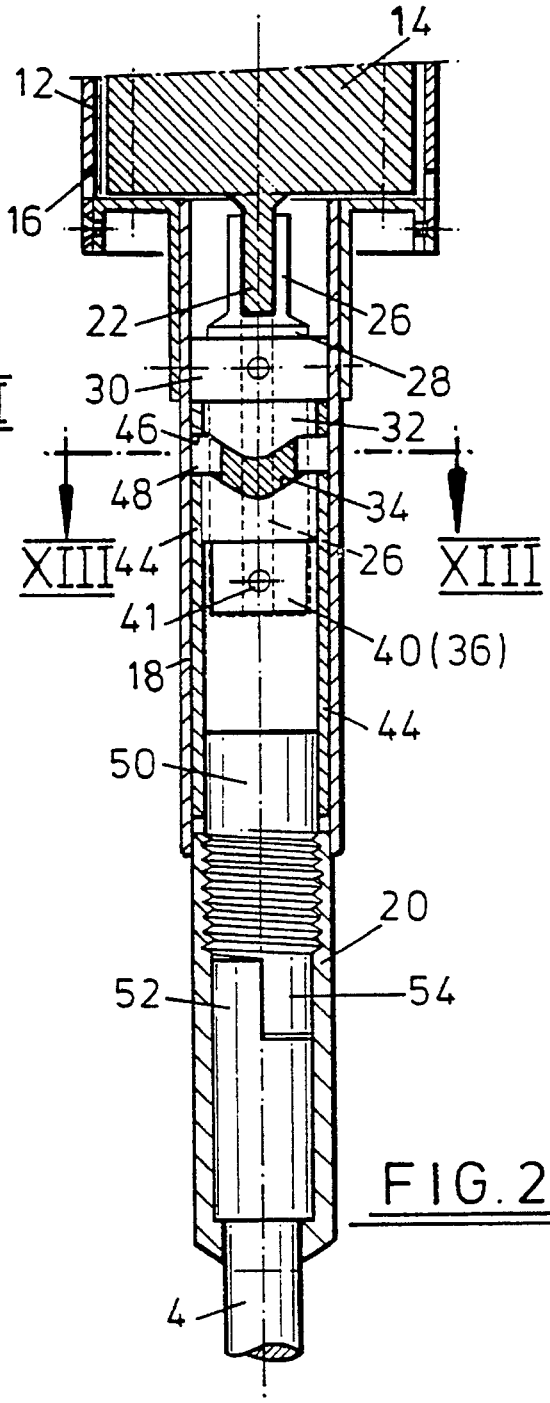
FIG. 2 is a longitudinal section through an intermediate portion of the tool of FIG. 1, to an enlarged scale.
Figure 3:
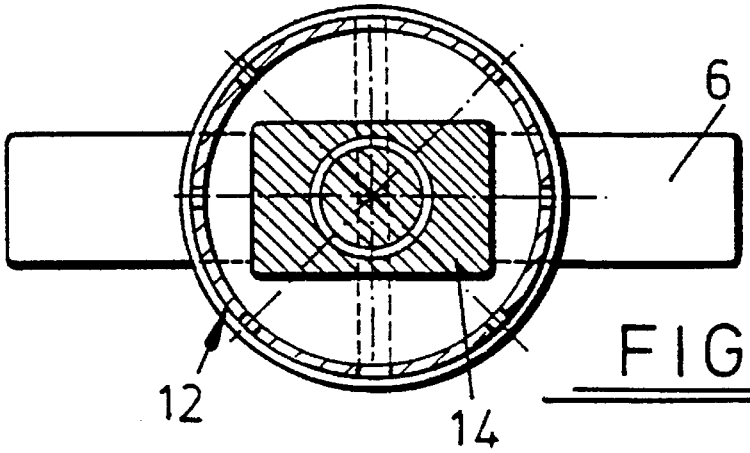
FIG. 3 is a section on line III—III of FIG. 1, excluding power cable mounting point.

The tool comprises a handle 6 incorporating a trigger grip 8 operating the power supply through a cable 10. The handle is secured to a dome-shaped end cap 11 of a housing 12 for an electric motor 14 (FIG. 2).

The housing 12 is provided with ventilation slots 16 and may be constructed in one of two sizes, long or short housing, according to the end use. A tubular casing 18 extends from the housing and from the casing projects a retaining collar 20 secured to a drive shaft to be described below, in which collar the tool bit 4 is mounted.

The construction of the device is as follows. An output shaft 22 from the motor is provided with two flats for entry into a shaped recess 24 of a subshaft 26, a collar 28 of which abuts against a thrust bearing 30 in which the subshaft 26 is mounted. The thrust bearing 30 is secured to the casing 18.

Figure 10:
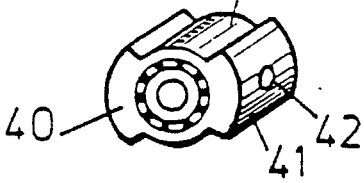
FIG. 10 is a cam thrust bearing.
Figure 11:
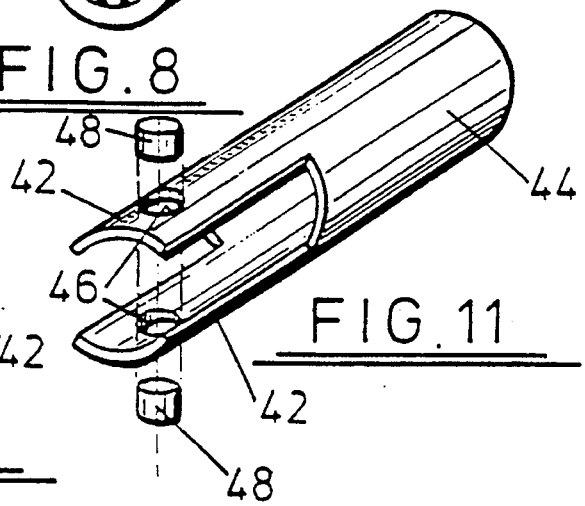
FIG. 11 is a perspective view of a hollow drive shaft of the tool.

Mounted on the subshaft 26 for rotation therewith is a cylinder cam 32 with a circumferentially arranged sinusoidal cam track 34. The lower end of the subshaft 26 is mounted in a thrust bearing 36. The bearing 36 is illustrated in FIG. 10 and it will be observed that the outer annular member thereof is formed with two opposed portions 40 of larger diameter which are secured at 41 by bolts (not shown) to the casing 18 so as to leave two arcuate gaps through which project respectively two extension portions 42 of a hollow drive shaft 44. The drive shaft is received in the casing 18 so as to permit of axial movement only.

Each extension portion 42 is provided with an aperture 46 in which is received a stud, strut, boss or like element 48 adapted for rotation within the aperture and which projects inwardly from the extension portions 42 into the cam track 34 of the cylinder cam 32.

Figure 12A:
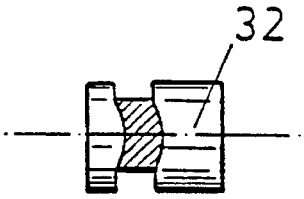
FIG. 12 *a–c*, show a range of cylinder cams having various dimensions.
Figure 12B:
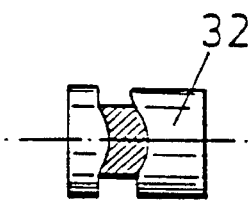
Figure 12C:
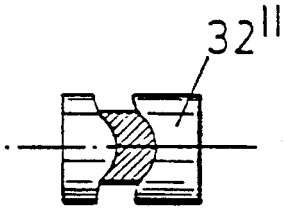
Figure 13:
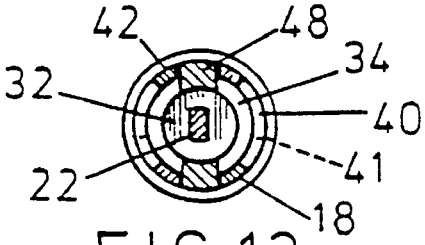
FIG. 13 is a sectional view on line XIII—XIII of FIG. 2.
Figure 14:
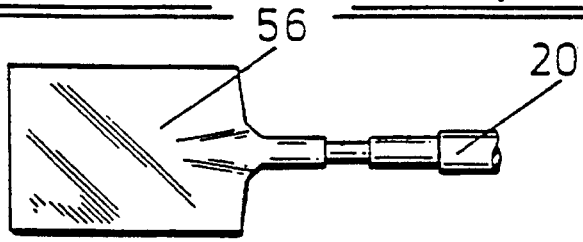
FIG. 14 shows an alternative tool bit for use with the tool according to the invention.

Rotation of the cam 32 by the motor therefore causes the elements 48 to move axially with respect to the center axis of the tool, and this causes the drive shaft 44 to move axially in a reciprocating manner. The stroke of the reciprocating movement is determined by the throw the cam track, which may be selected from, for example, the range of cams 32, 32' and 32" shown in FIGS. 12 *a–c*, i.e., 2 mm, 4 mm and 6 mm respectively.

An end piece 50 secured in the lower end of the drive shaft 44 is externally threaded to receive the bit retaining collar 20 which surrounds a tool bit, in the present example the chisel bit 4. The upper end portion of the bit 4 is step-contoured at 52 to engage with a complementary step 54 on the end piece 50.

Figure 4:
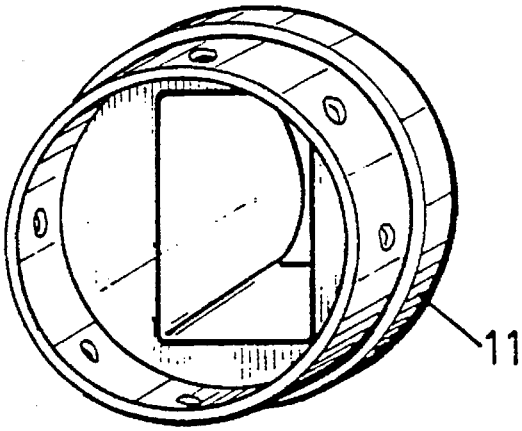
FIG. 4 is a perspective view of the motor housing end cap.
Figure 5:
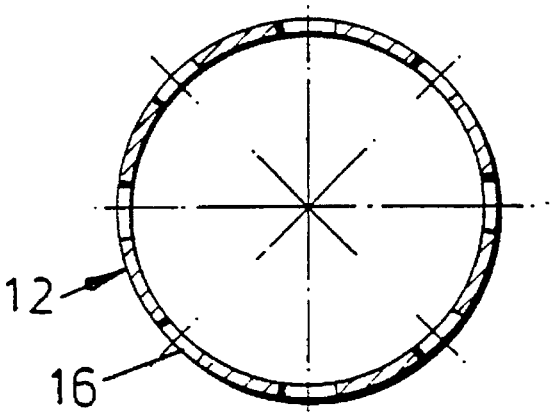
FIG. 5 is a section on line V—V of FIG. 1.
Figure 6:
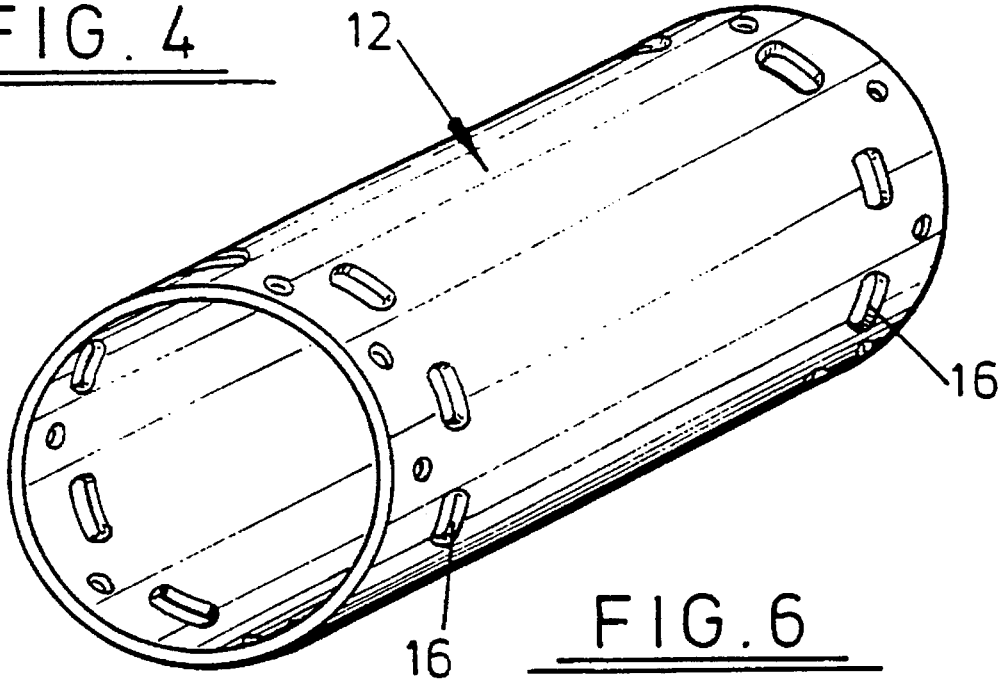
FIG. 6 is a perspective view of the motor housing.
Figure 7:
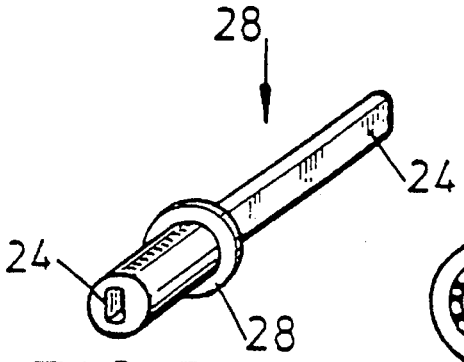
FIG. 7 is a perspective view of the motor subshaft.
Figure 8:
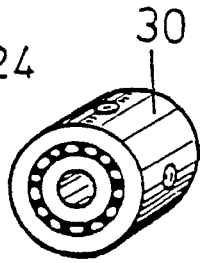
FIG. 8 is a subshaft thrust bearing.
Figure 9:
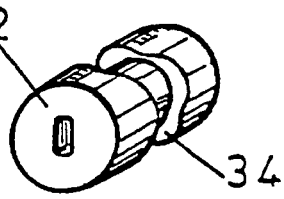
FIG. 9 is a perspective view of a cylinder cam.

It will be understood that the power tool is principally intended for small scale use, for example as a cold chisel, or as a spade, as illustrated at 56 in FIG. 4, but may also be used in a smaller form as a hand-held tool, for example, for scraping or stripping paint, wallpaper or the like.

Figure 15:
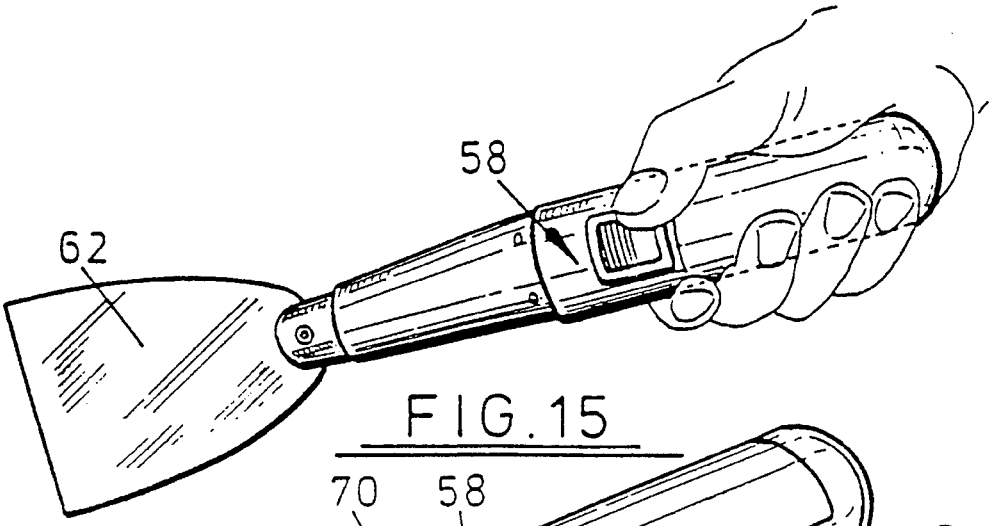
FIG. 15 shows a hand-held version of a tool according to the invention.
Figure 16:
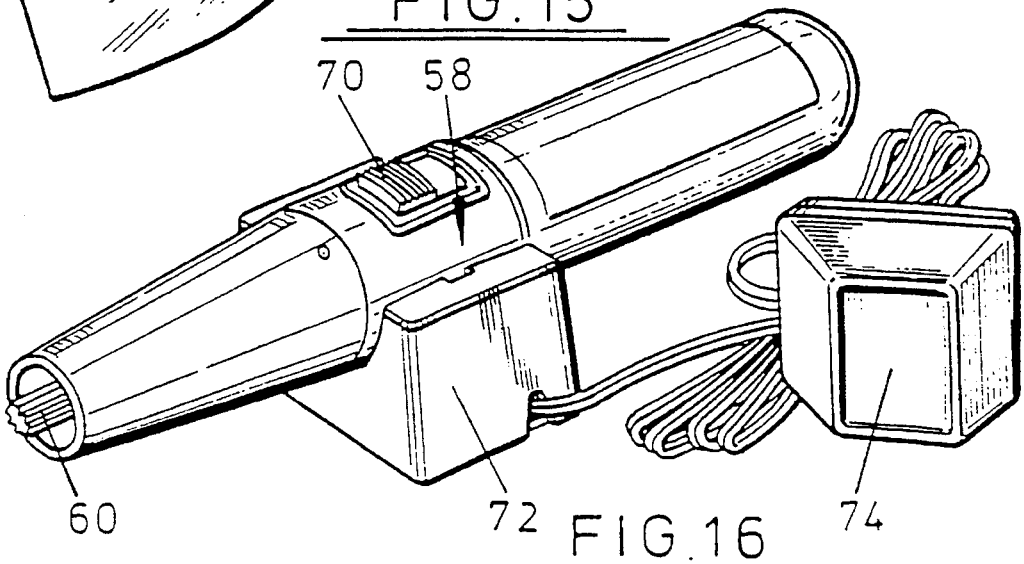
FIG. 16 illustrates the tool of FIG. 15 in a battery recharging mode.
Figure 17A:
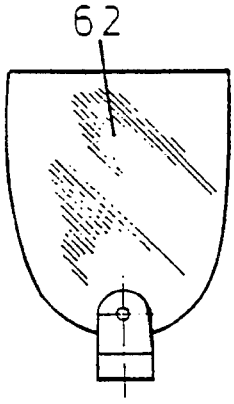
FIG. 17 *a–d*, show possible alternative tool bits for use with the tool of FIG. 15.
Figure 17B:
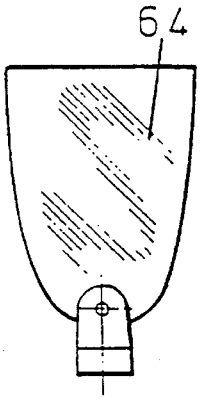
Figure 17C:
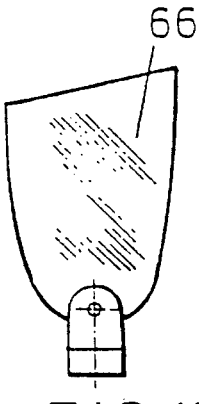
Figure 17D:
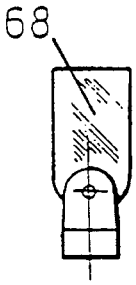

FIG. 15 illustrates an example of such a hand-held tool. While the operating mechanism of the hand-help tool differs only in scale from that already described above, the electric motor within a housing 58 is battery operated and instead of acting on the bit 4 through a hollow drive shaft, operates a splined drive shaft 60 to which may be attached a variety of tools such as 62, 64, 66 or 68 as shown in FIG. 17. The rotation of the shaft 60 is controlled through suitable reduction gearing (not shown). A finger-operated switch 70 is provided and the batteries may be recharged by positioning the device in a charging base 72 to which is connected a charge unit 74.

Figure 18:
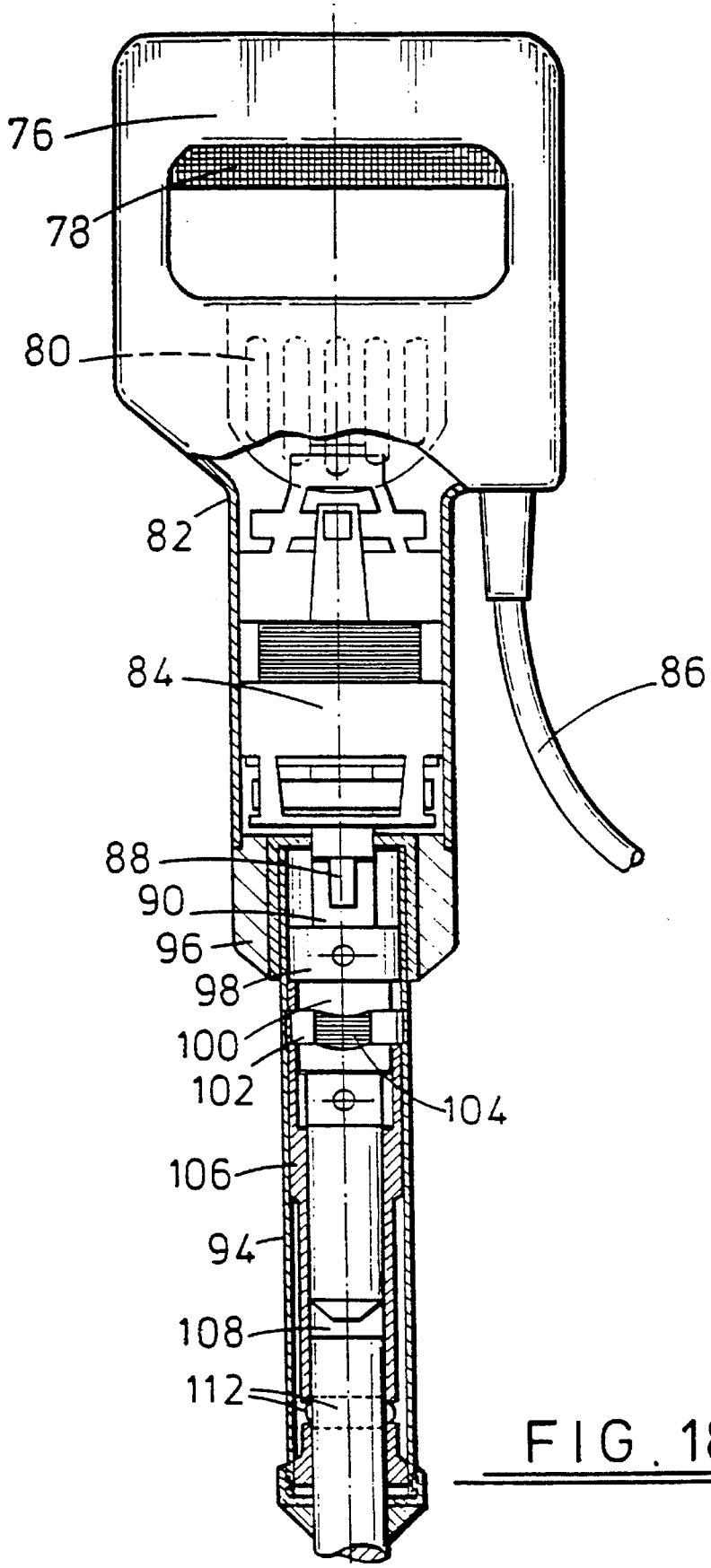
FIG. 18 is a view partly in section, of a power spade according to the invention.

The device illustrated in FIG. 18 is a power cutter comprising a handle 76 with an on/off trigger switch 78. Ventilation slots 80 are provided in a motor housing 82 molded from hard plastics material. A rotary motor 84, supplied with power via a cable 86, is selected for good torque characteristics and a suitable r.p.m. figure of at least 10,000. A motor output shaft 88 engages a socket 90 of an extension of a hollow main shaft 94 secured to a shaft support 96, and operating in an upper thrust bearing 98. A cam cylinder 100 converts the rotational motion of the motor output shaft to oscillating (reciprocating) movement by cam followers 102 engaging in a sinusoidal wave cam track 104.

A tool bit support shaft 106 has a sliding fit in the main shaft 94 and is contoured to reduce the area of friction between sliding surfaces. An end stop 108 is provided for the shaft 106. A tool bit (not shown) has a shaft 110 insertable in the support shaft 106 and retainable by a ball-and-socket arrangement 112.

Figure 19A:
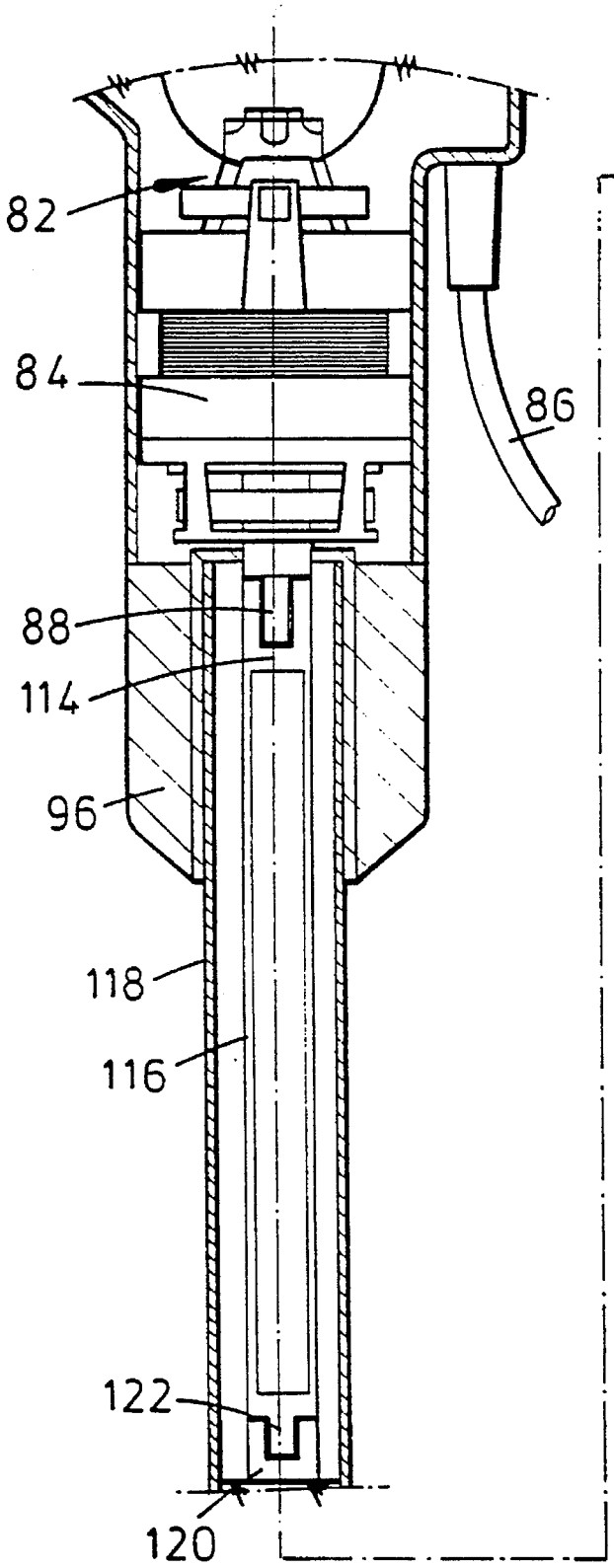
FIGS. 19*a*–19*b* is a similar view of a portable cutter.
Figure 19B:
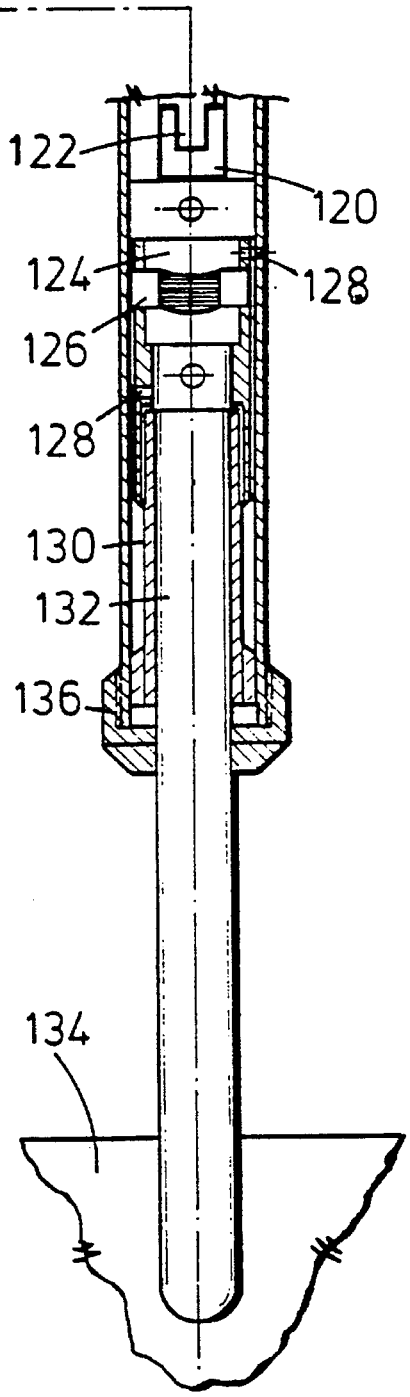

FIG. 19 shows a power spade, (FIG. 19*b* is a continuation of FIG. 19*a*). Component parts similar to those of FIG. 18 are given the same reference numerals. The motor output shaft 88 is received in a socket 114 of a hollow extension shaft 116 received within a main shaft 118, comprising a rigid alloy tubular member. A further socket 120 receives the lower end 122 of the extension shaft, the socket 120 being integral with a cam cylinder 124 the rotation of which causes cam follower 126 to reciprocate as before to cause lengthwise movement of the cam follower mounting shaft 128.

The hollow shaft 128 receives a support member 130 for the shaft 132 of spade blade 134. The coaxially arranged shafts are sealed by an end cap 136.

Figure 20:
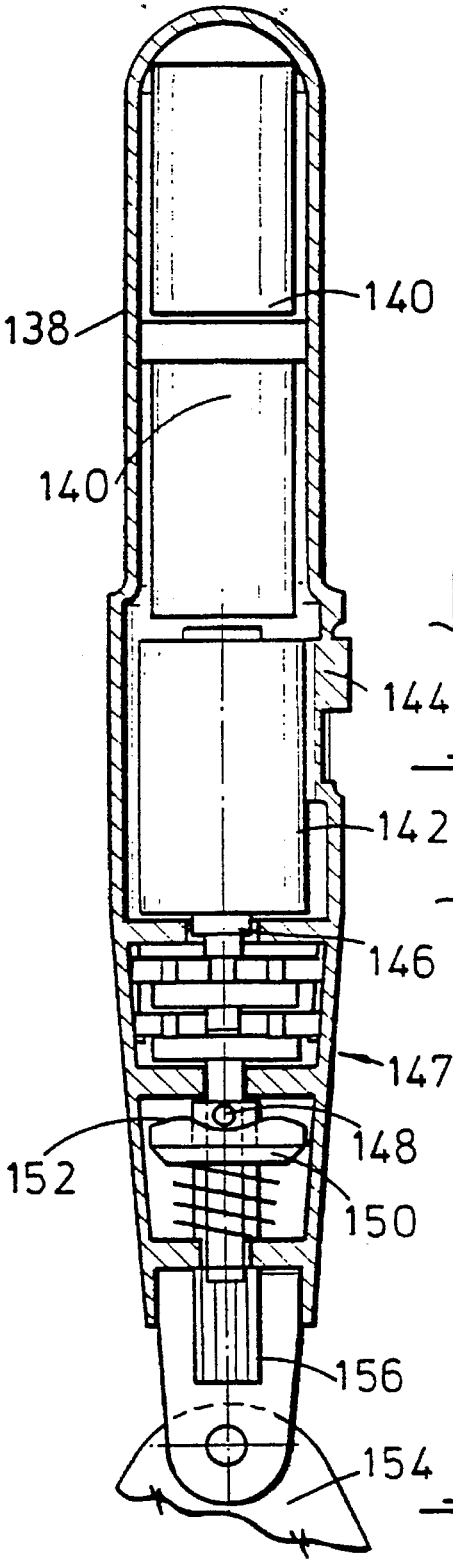
FIGS. 20 to 29 show various alternative layouts and modifications of devices according to the invention.

FIG. 20 shows a hand-held device suitable for use as a scraper, for example for wallpaper. A housing 138 encloses two replaceable batteries 140 which operate a motor 142 according to the position of an on/off switch 144. An output shaft 146 from the motor operates through a two-stage reduction gear device 147 to cause a cam follower arrangement 148 to rotate. A cam wheel 150, with a radially disposed cam surface 152 spring-biased towards the cam follower 148, is held captive against rotation so that it is caused to partake of reciprocating movement in an axial direction. This movement causes the desired reciprocating movement of the scraper tool blade 154 secured thereto at 156.

Figure 21:
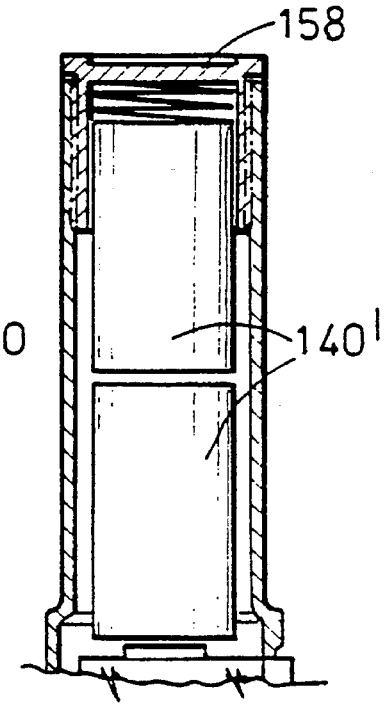
Figure 22:
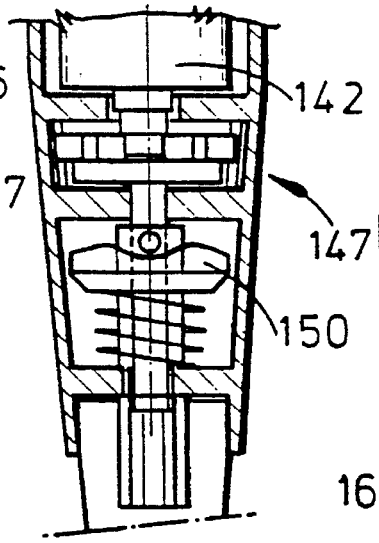

Whereas the batteries 140 of the device of FIG. 20 may be rechargeable, the batteries 140' of FIG. 21 are readily replaceable by removal of the end cap 158. FIG. 22 shows a similar device to that of FIG. 20, including a single-stage reduction gear device 147'.

Figure 23:
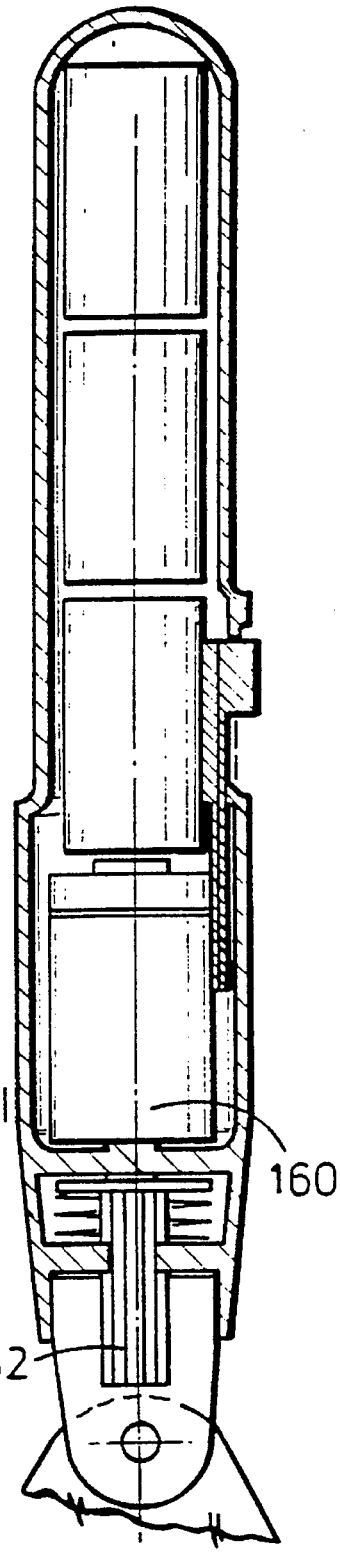

In FIG. 23, there is illustrated a modification of the scraper-tool in which the reciprocating movement is imparted by a linear output motor 160 to a spring-biased member 162 to which the scraper tool blade is securable.

Figure 24:
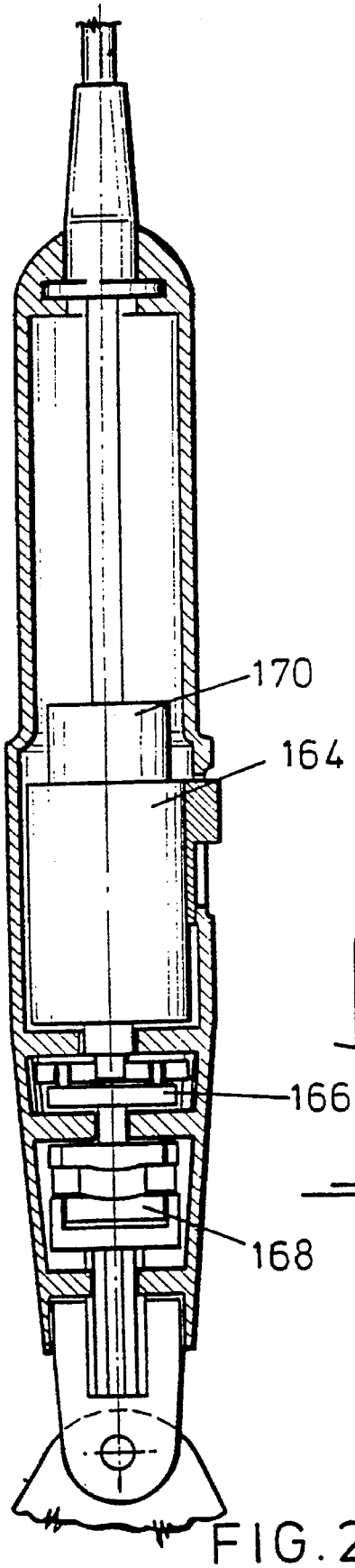

FIG. 24 shows a scraper tool in which the motor 164 is operated by mains electricity, the output of the motor illustrated being taken through a single-stage reduction gear device 166 to a cam cylinder 168. A transformer 170 is also provided.

Figure 25:
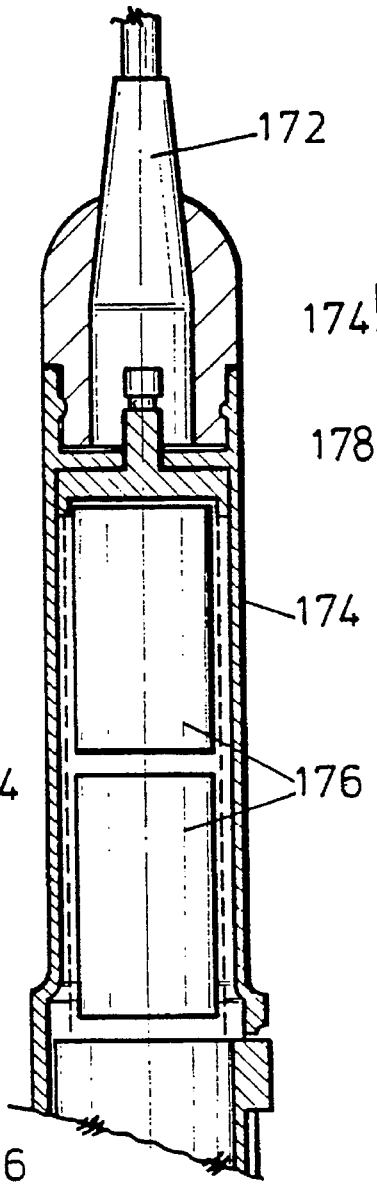

It will be understood that it may also be considered more convenient for a linear output motor to be operated by mains electricity. However, in FIG. 25, a dual power source arrangement is shown in which a cable connector 172 may be removed from the housing 174, for example to cope with access to difficult locations, and a set of stand-by batteries 176 are then available for short-term use.

Figure 26:
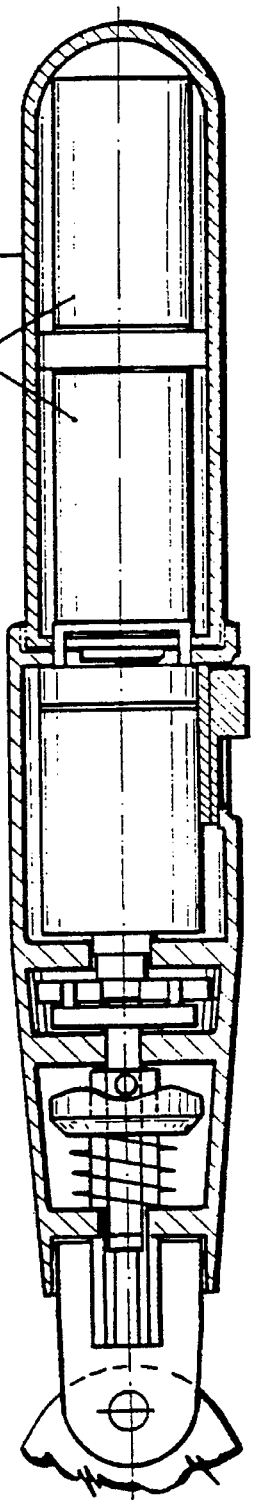

In FIG. 26, the arrangement shown incorporates a convenient form of battery replacement in which the batteries 178 and an end portion of the housing 174' are detachable as a quickly replaced module to minimize delays in completing a desired operation.

Figure 27:
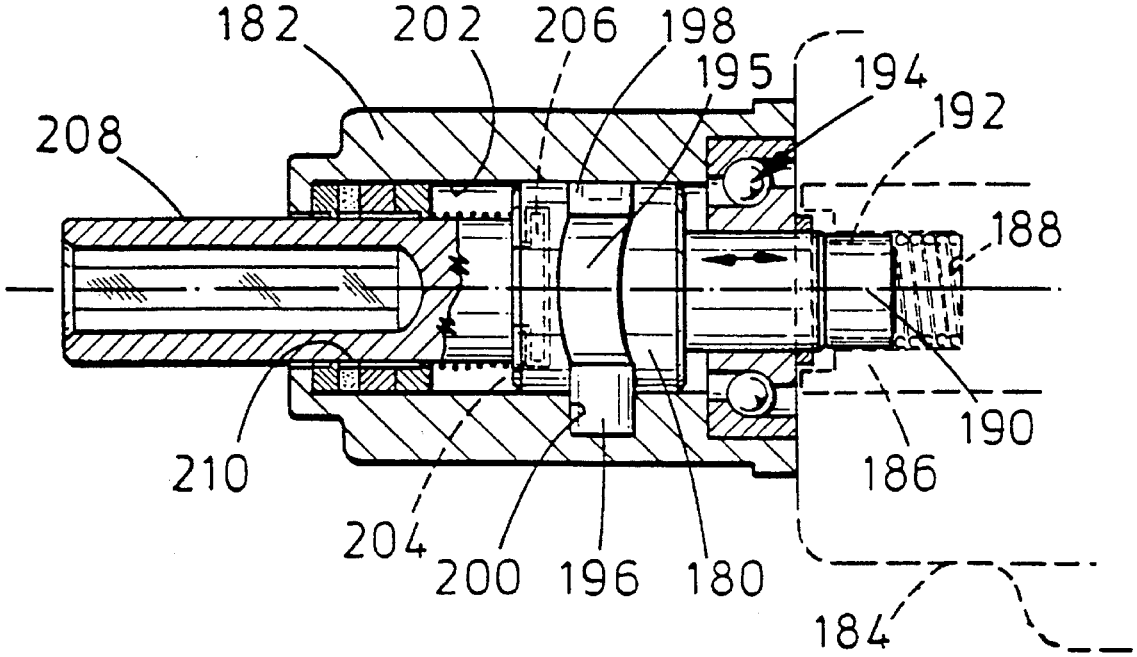

In FIG. 27, an alternative arrangement is shown in which a cylinder cam 180 is mounted for rotation in a housing 182. The housing 182 may be, as illustrated, in the form of a nose portion of a hand-held power drill 184, an output member 186 of which is provided with a splined recess 188 in which is received a shaft 190 fixed to the cam 180.

The shaft 190 which has splines 192 is arranged to move lengthwise as it rotates in bearings 194. The cylinder 180 is therefore mounted for limited axial movement in addition to its rotary movement, by the action in a cam track 195 of cam followers 196, 198 which may be in the form of studs, struts, bosses or like elements 196 mounted in recesses 200 in the housing as shown in the lower half of the Figure or in the form of bosses 196 provided on the inner surface 202 of the housing as shown in the upper half of the Figure.

A recess 204 formed in the cam cylinder 180 receives a head portion 206 of an output shaft 208 which emerges from the housing 182 through splined members 210, which prevent rotary movement of the shaft 208, but allow the reciprocating axial movement of the cylinder to be transmitted to the workpiece.

Figure 28:
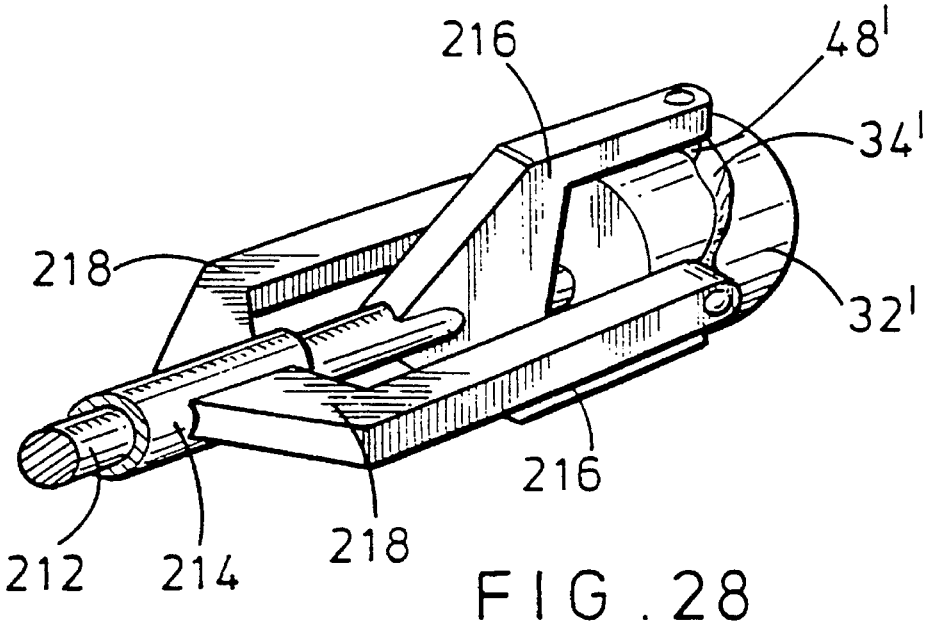

FIG. 28 shows an alternative form of the drive shaft extension portions illustrated in FIG. 2. In FIG. 2, a single hollow drive shaft 44 is provided with two extension portions 42 in which are mounted studs 48 which engage with a cam track 34 of a cylinder cam 32 at regions 180° apart. FIG. 28 shows an output shaft arrangement having two output shafts 212 and 214, each having two extension portions, 216, 216 and 218, 218 respectively. End portions of each extension portion (216, 216; 218, 218) are each provided with cam followers 48' arranged at regions of the cam track 34' in the cylinder 32', at regions 90° apart.

Figure 29:
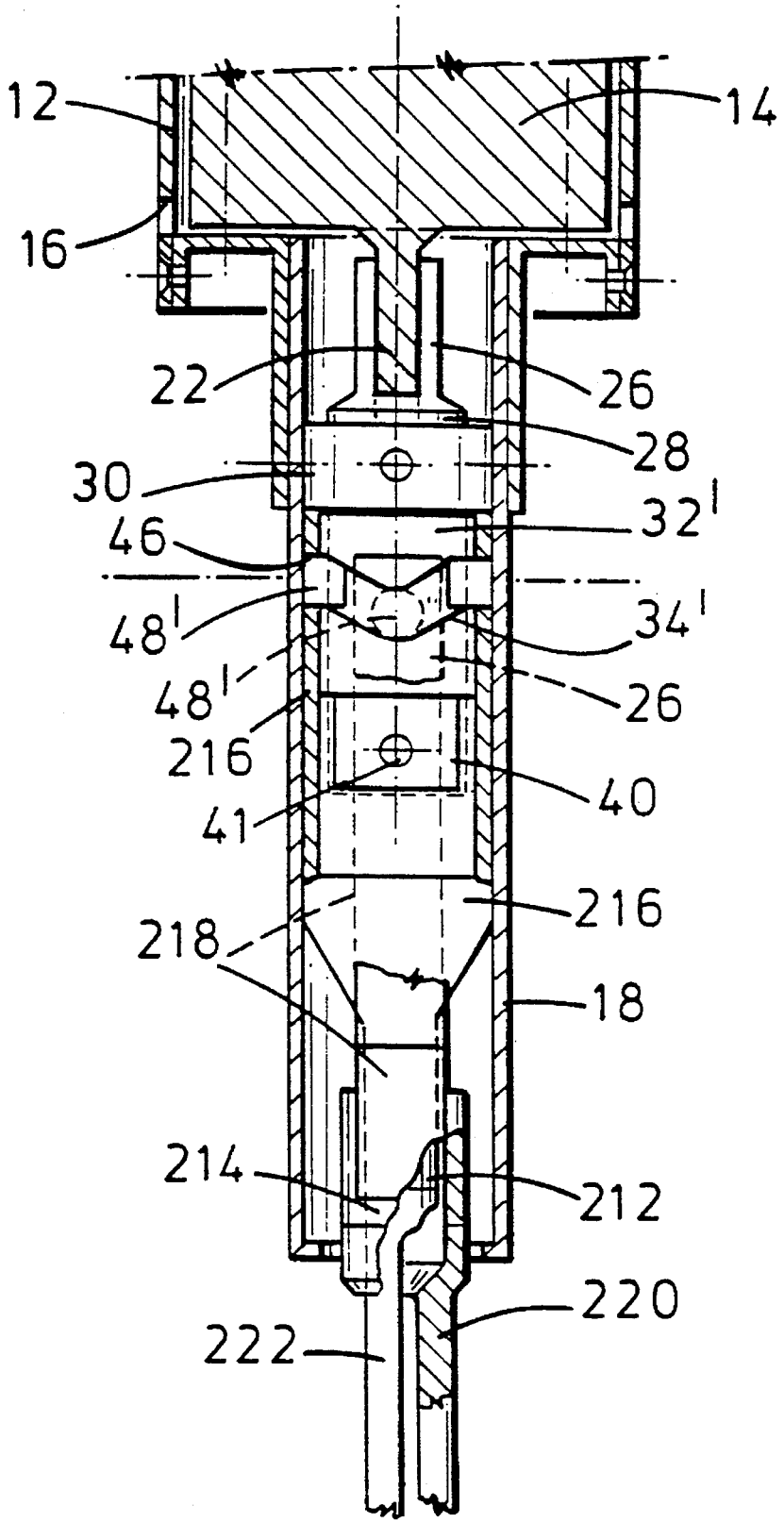

An example of the arrangement described above is shown in FIG. 29 in which parts identical with corresponding parts in FIG. 2 have been given like reference numerals. In this example, the shaft 212 is extended by means of a tool bit 222 and the hollow shaft 214 is extended by means of a tool bit 224. Thus, in operation the two tool bits will partake of lengthwise reciprocating movement as the cam cylinder rotates. The two bits 222 and 224 will operate in opposed directions to provide a double-rate hammer action upon a workpiece.

I claim:

1. A portable power tool powered by associated drive means and comprising a housing, and a mounting arrangement for operably coupling an output shaft to an element, such as a selected one of a plurality of interchangeable tool bits, to which reciprocal axial movement is to be imparted, said housing including an output arrangement for driving said output shaft in a reciprocal axial movement to correspondingly drive said element, said output arrangement including a cylinder cam mounted for rotation with a drive shaft rotationally driven by said drive means, said cam which is received within a hollow portion of said housing, comprising a cylindrical body having circumferential outer surface, a continuous sinusoidal recessed groove being formed in said outer surface at a position spaced from edge portions of said surface, said groove providing a sinusoidal cam track and cam follower means in the forms of at least two studs, struts or bosses mounted so as to project inwardly with respect to said housing, said cam follower means being capable of running in said cam track to impart said reciprocal motion to said output shaft.

2. A power tool as set forth in claim 1, wherein said cam follower elements are mounted to project from an inner surface of said housing, said cam cylinder is mounted for rotational and lengthwise axial movement within said housing, and said output shaft is connected to said cam cylinder so as to partake of lengthwise axial movement only.

3. A power tool, as set forth in claim 1, wherein said cylinder cam is selected from a plurality of cam members having a range of throw distances.

4. A power tool, as set forth in claim 1, wherein intermediate gearing is interposed between said drive means and said output shaft.

5. A power tool, as set forth in claim 1, wherein said drive means is powered by means of electricity.

6. A power tool, as set forth in claim 1, wherein said drive means is powered by a battery.

7. A power tool, as set forth in claim 1, wherein said drive means includes a battery/handle module which is detachable for rapid replacement.

8. A power tool, as set forth in claim 1, wherein said tool bit is selected from the group comprising a wallpaper scraper, a wallpaper stripper, a paint scraper, a paint stripper, a cold chisel, and other similar small hand-held tools.

9. A power tool, as set forth in claim 1, wherein said tool bit is selected from the group comprising a spade, an earth-breaking drill, a cutter, and a stone-chipping device.

10. A portable power tool powered by associated drive means and comprising a housing, and a mounting arrangement for operably coupling an output shaft to an element, such as a selected one of a plurality of interchangeable tool bits, to which reciprocal axial movement is to be imparted, said housing including an output arrangement for driving said shaft in a reciprocal axial movement to correspondingly drive said element, wherein said output arrangement includes a cylinder cam mounted for rotation with a drive shaft rotationally driven by said drive means, said cam being received within a hollow portion of said housing and provided with a sinusoidal cam track extending around its circumferential surface, and cam follower means in the form of at least two studs, struts or bosses mounted so as to project, and wherein said output shaft comprises two shaft portions, each of said shaft portions comprising two diametrically opposed extension portions, each of the four extension portions being provided with one of four of said studs, struts or bosses forming said cam follower means, and wherein the four studs, struts or bosses are arranged equidistantly around the cam track so that each of the two shaft portions partake of lengthwise reciprocating movement in opposed direction to the other, and securing means provided on each shaft portion for securing one of said tool bits.

* * * * *